United States Patent [19]

Nowak

[11] 3,986,694

[45] Oct. 19, 1976

[54] PAINT PAIL SUPPORT

[76] Inventor: William J. Nowak, R.D. No. 3, New Berlin, N.Y. 13411

[22] Filed: June 2, 1975

[21] Appl. No.: 582,911

[52] U.S. Cl. ..... 248/211; 248/226 C

[51] Int. Cl.[2] ..... E06C 7/14

[58] Field of Search..... 248/210, 211, 215, 226 C, 248/226 D, 227, 316 B, 316 C

[56] References Cited

UNITED STATES PATENTS

| | | | |
|---|---|---|---|
| 722,349 | 3/1903 | Young | 248/211 |
| 2,166,533 | 7/1939 | Oettel | 248/226 C |
| 2,287,485 | 6/1942 | Pierce | 248/226 C |
| 2,912,205 | 11/1959 | Toune | 248/210 |
| 3,013,759 | 12/1961 | Close | 248/211 |
| 3,313,507 | 4/1967 | Belli | 248/211 |
| 3,353,778 | 11/1967 | Sylvain et al. | 248/211 |

FOREIGN PATENTS OR APPLICATIONS

| | | | |
|---|---|---|---|
| 878,165 | 6/1953 | Germany | 248/226 C |

*Primary Examiner*—Robert A. Hafer
*Attorney, Agent, or Firm*—Bauer, Amer & King

[57] ABSTRACT

A ladder-supported device for the suspension of a paint can or pail in which the body of the device is formed by two members which cooperate to form a hinge at their confronting edges, and wherein the support rod-like element for the pail includes a depending length portion which effectively completes the hinge by serving as the hinge pin, and also connects the support element to the body. The pivotal traverse of the hinge readily facilitates the attachment of the device to, and its detachment from the ladder.

10 Claims, 5 Drawing Figures

PAINT PAIL SUPPORT

The present invention relates to a support for a paint can or pail and the like of the type which is supported on a ladder to thereby conveniently locate the pail and its contents for the user of the ladder, and more particularly to an improved support of this general classification which is readily provided with its supported position on the ladder, and also readily moved to different locations therealong, as required.

It is already well known in the patent literature, as exemplified by U.S. Pat. Nos. 2,686,033 and 3,353,778, that there is value to a convenience attachment for ladders which permits the suspension of a paint pail by its bail on such an attachment, since this in an obvious manner makes the paint contents of the pail readily accessible to one painting while on the ladder. In these known paint pail supports, attachment to the ladder is achieved by movement of a threadable element into engagement with the ladder side member, or by otherwise establishing physical contact which fixes the position of the attachment or support on the ladder. The structural features provided to establish this physical contact unavoidably complicate the construction of the support and its mode of use, as well as increase its manufacturing cost.

Broadly, it is an object of the present invention to provide a paint pail support of the type which is selectively positionable on, as well as along a ladder side member, overcoming the foregoing and other shortcomings of the prior art. Specifically, it is an object to provide a ladder-mounted paint pail support of readily simple construction, which is easy to mount on a ladder and also readily positioned therealong.

A paint pail support selectively attachable to a side member of a ladder demonstrating objects and advantages of the present invention includes a cooperating pair of body members operatively arranged relative to a pivot axis for movement in enclosing relation about said ladder side member. A first and a second hinge member is respectively provided on each body member at a location coincident with the pivot axis to provide the hinge function. Completing both the hinge and the support is a laterally extending rod-like element having a length portion which serves as the hinge pin, depending from one end so as to be adapted to be projected through said first and second hinge members, to thereby pivotally connect the body members to each other, and also connect the rod-like support in laterally extending supporting position from the body members.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
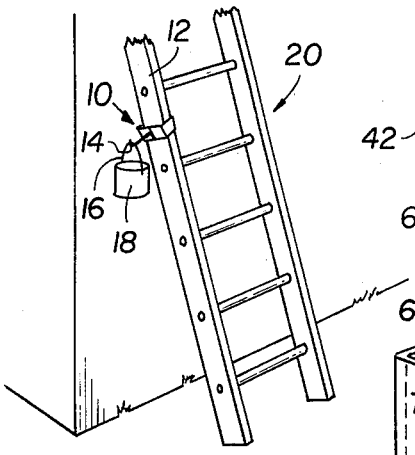
FIG. 1 is a perspective view illustrating the operative position of a paint pail support according to the present invention on a ladder side member.

Reference is now made to the drawings, and in particular to FIG. 1 wherein there is shown a paint pail support, generally designated 10, demonstrating objects and advantages of the present invention. Support 10, as illustrated in FIG. 1, has an operative position, as explained in greater detail subsequently, in which it is located at any selected position along a ladder side member 12. In said selected position, the support 10 presents a laterally extending support member 14 over which the bail 16 of paint can 18 is placed, thereby conveniently making accessible the contents of the can 18 to a painter using the ladder 20. Although supports in the same classification as the support device 10 hereof are already well known in the patent literature, as for example, in U.S. Pat. Nos. 2,686,033 and 3,353,778, the ease with which the device 10 is readily provided with its supported position on the side member 12 and also moved to different locations therealong is not known and constitutes a noteworthy advance in the art, as will now be explained in detail.

Figure 2:
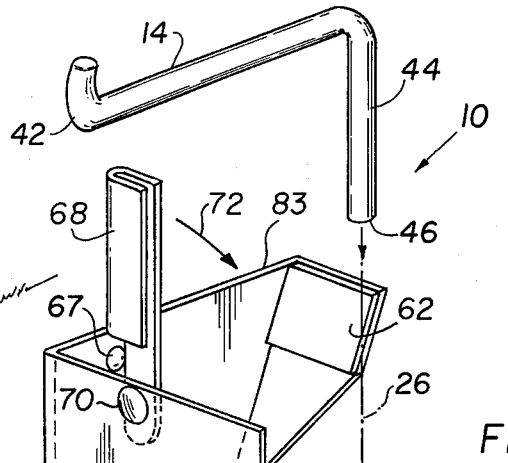
FIG. 2 is a perspective view, on an enlarged scale, illustrating the various parts and the manner in which they assemble to provide the paint pail support hereof.

As is perhaps best shown in FIG. 2, the support device 10 includes two body members 22 and 24, which are arranged for pivotal movement relative to each other about a pivot axis 26. More particularly, in accordance with the present invention the body members 22 and 24 contribute to the establishment of the pivot axis 26 by virtue of each respectively having a hinge member or construction 28 and 30 at staggered locations, as illustrated in FIG. 2, along their respective confronting edges 32 and 34. Thus, each hinge construction 28 and 30, as generally understood, consists of a cylindrical shape with a central opening 36 and 38 respectively. The placing of the edges 32 and 34 in adjacent position, as indicated by reference arrow 40, automatically places the cylindrical openings 36 and 38 in alignment with each other, and thereby establishes the previously noted pivot axis 26.

Still referring to FIG. 2, it will be further noted that the paint pail support member 14, referred to in reference to FIG. 1, is of a rod-like construction including a turned-up hook 42 which, in an obvious manner, prevents the bail 16 of the paint can 18 from inadvertently slipping off of the support member 14. At its opposite end, the support member 14 includes a depending length portion 44 which is advantageously used as a hinge pin and completes the construction of a hinge using the hinge members 28 and 30. That is, length portions 44 is adapted to be projected through the aligned hinge members 28 and 30 and the bottom surface 36 thereof when swaged, at 46 as illustrated in FIG. 5, thereafter prevents its inadvertent removal.

Figure 3:
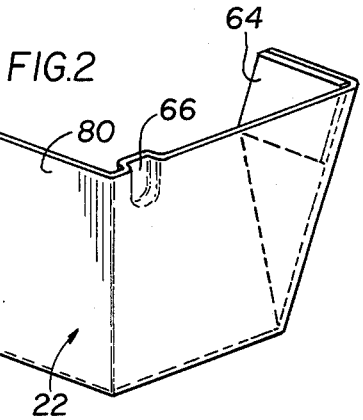
FIG. 3 is a perspective view of the paint pail support hereof in assembled condition.
Figure 3:
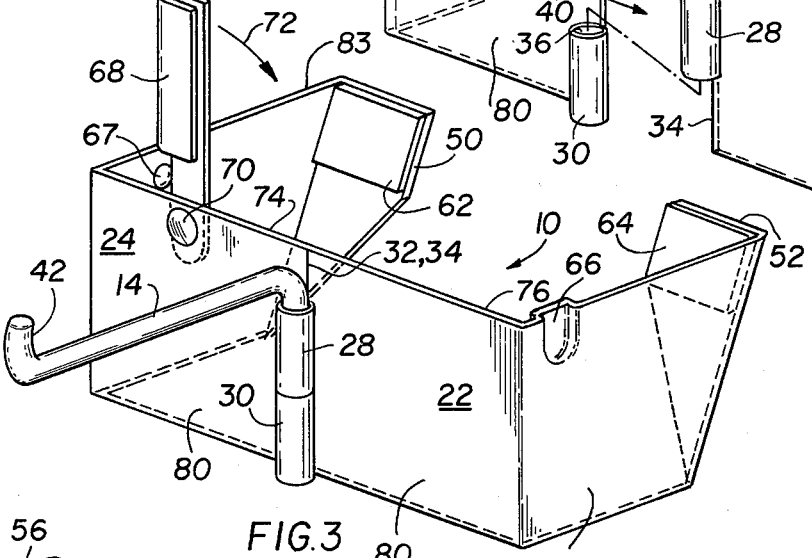
Figure 4:
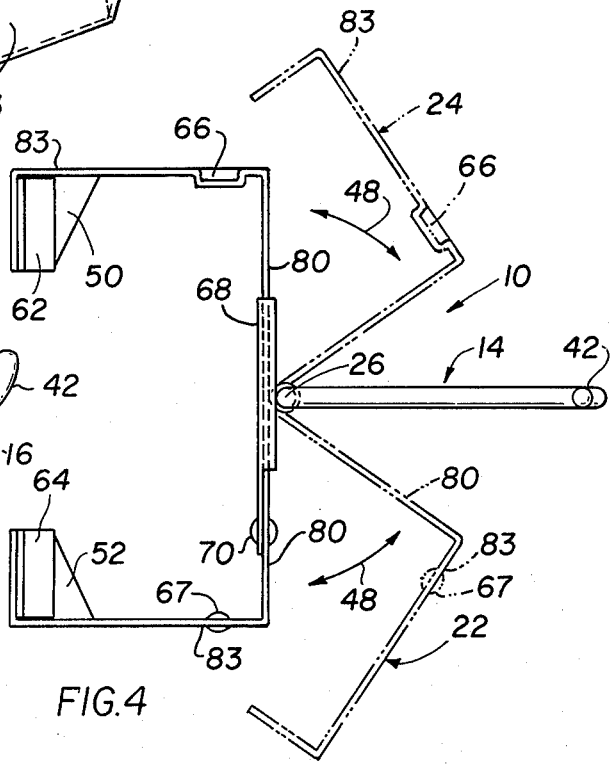
FIG. 4 is a plan view of the support in which the pivotal movement thereof is illustrated in full line and phantom line perspective.

As may best be appreciated from FIG. 4, to achieve the FIG. 1 operative position for the support device 10 it is necessary merely to urge the body members 22 and 24 about the pivot axis 26 through closing movement 48 about the ladder side member 12. As illustrated in FIGS. 3, 5 in conjunction with FIG. 4, closing movement 48 of the body members 22 and 24 advantageously locates angularly oriented rear walls 50 and 52 on these body members behind, and thus in engaging relation, with the ladder side member 12. Because of the angular orientation of the walls 50, 52, the weight of the paint can 18 and its contents, as illustrated best in FIG. 5, exerts a moment force 54 on the device 10 which moves the rear walls 50, 52 flush against the rear surface 56 of the ladder side member 12 and also moves the lower edge 58 of the body members 22, 24 into engaging contact with the opposite surface 60 of the ladder side member 12. The contact thus established by the rear walls 50, 52 and the edge 58 results in the device 10 maintaining a selected elevated position along the ladder side member 12. To supplement the frictional engagement between the rear walls 50 and 52 with the surface 56 of the ladder side member 12, each of the walls has a patch 62, 64 of elastomeric or other appropriate friction material adhesively secured to it.

Figure 5:
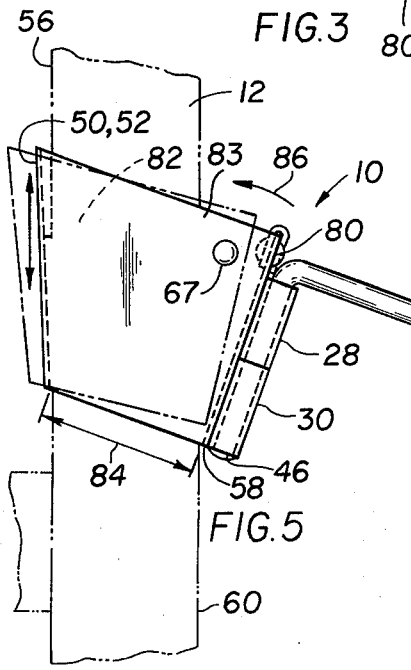
FIG. 5 is a side elevational view of the support hereof in which the positioning thereof on the ladder incident to sliding movement along the ladder side member is illustrated in the full line and phantom line perspective.

In the event that paint can 18 is removed from its suspended position on the laterally extending support 14, thereby removing the moment force 54, the device 10 may be inadvertently tilted to its broken line position as shown in FIG. 5. This may result in a tendency of the device 10 to slip down along the ladder side member 12. To prevent this, a protruding detent member 66 is provided to engage the side of the ladder member 12 and thereby prevent such inadvertent sliding movement of the device 10. The detent member 66 is here shown in the form of a bend or deformation made in the side wall by a depression. However, those skilled in the art will readily recognize that the protrusion may take many forms including a rivet extending inward from and beyond the wall as shown for illustrative purposes only as at 67.

Effective use of the device 10 is enhanced by preventing inadvertent opening movement of the body members 22 and 24, and thus their inadvertent disengagement from the ladder side member 12. One preferred means of achieving this contemplates the use of a locking member 68 pivotally mounted, as at 70, on the body member 24 and thus movable through a pivotal traverse 72 into spinning relation across the confronting edges 32, 34 of the body members in engagement with the upper edges 74 and 76 of the body members. To this end, locking member 68 has a substantially U-shape in cross section and thus bounds a slot 78 for receiving therein the body member upper edges 74 and 76.

As best shown in FIG. 5, the fact that the rear walls 50 and 52 are angularly oriented in relation to the generally vertically oriented front walls 80 of the body members 22, 24 results in a ladder side member-receiving compartment 82 of a varying extent. That is, at the lowermost portion of compartment 82 where, due to the angular orientation of the rear walls 50, 52, these walls are closest to the lowermost edge 58 of the front walls 80, the distance separating these structural features is of the nominal amount designated 84 in FIG. 5. It will be understood that distance 84 is sized relative to the thickness of the ladder side member 12 to result in engagement of the lower edge 58 at only a slight angular orientation in the laterally extending support rod 14. However, as may readily be appreciated from FIG. 5, proceeding upward from the plane of the reference 84, compartment 82 is of progressively increased size. As a consequence, when it is desired to shift device 10 along the ladder side member 12, this is readily achieved by turning the device 10 in the direction 86 which, of course, disengages the edge 58 from the surface 60. Also, it presents the distance 84 in horizontal relation to the side member 12, somewhat like the hypotenuse of a triangle, and thus there is ample sliding clearance between the bottom of the compartment 82 and the side member 12. The upper portion of the compartment 82, because of its increased size, is large enough to also define sliding clearance between it and the ladder side member 12 despite the slight pivotal traverse 86. The result is that the device 10, after the traverse 86, is free of engagement with the ladder side member 12 and thus is readily moved up or down along this member into another selected operative position.

From the foregoing, it should be readily appreciated that the paint pail support 10 hereof is of relatively simple construction, easy to install in supported position on a ladder, and also is readily positioned therealong.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

It has been noted that the member 14 functions as the common pivot to hold together the cooperating hinge members 28 and 30. It should be apparent to those skilled in the art that this simple expedient also enables the member 14 to be pivotally moved and rotated within the supporting hinge members 28 and 30 so that its hook end 42 may be placed in any desired location, a feature that is unique in the art.

In practice, only one member 66 has been utilized on one side wall. However, it will be recognized by those skilled in the art that a member 66 may be provided in the other member 24 and in its respective side wall 83. In like manner, if the member 67 is used in preference to the member 66, it too may be used on one or both side walls 83. In the construction of the present device 10, the space between the inside of the walls 83 and the adjacent surfaces of the leg of the ladder to which the device 10 is applied is relatively small. Hence, a protruding detent provided on the inside surface of one or more of the walls 83 would suffice.

What is claimed is:

1. A paint pail support of the type selectively attachable to a side member of a ladder comprising a cooperating pair of body members having planar surfaces, said body members operatively arranged relative to a pivot axis for movement in enclosing relation about said ladder side member, a first and a second hinge member respectively on each said body member at a location coincident with said pivot axis, a laterally extending support having a length portion serving as a hinge pin depending from one end adapted to be projected through said first and second hinge members for pivotally connecting said members to each other and for connecting said support in laterally extending supporting position from said body members, and a pivotally mounted locking member on one of said body members movable into engagement with the other of said body members and spanning said pivot axis to lock said body members together with said planar surfaces in collinear relationship.

2. A paint pail support as claimed in claim 1 wherein each said body member has walls bounding a ladder side member-engaging compartment of a size corresponding at least to that of said ladder side member and increasing progressively to a size greater than the ladder side member, whereby in one angular orientation said body members cooperate to present a compartment sized to engage said ladder side member and in other angular orientations the same present a larger sized compartment to thereby permit sliding movement of said paint pail support along said ladder side member.

3. A paint pail support as claimed in claim 2 wherein said walls of said body members include front and rear walls located on opposite sides of ladder side member in said attached position of said support thereon, each said rear wall being angularly oriented in relation to said front wall to provide said ladder side member-engaging compartment of varying size.

4. A paint pail support as claimed in claim 3 wherein each said rear wall has an elastomeric surface in facing relation to said ladder side member to prevent inadvertent sliding movement of said support along said ladder side member.

5. A paint pail support as claimed in claim 3 said pivotally mounted locking member being on one said front wall movable into engagement with said other front wall in said spanning relation across said pivot axis, whereby in said spanning position of said locking member said body members are held against pivotal movement.

6. A support for application to a leg of a ladder and the like comprising a pair of members each of which has a planar surface with a cooperating hinge means and each member being relatively movable about a common pivot defining a part of said cooperating hinge means, a support member having a portion thereof engageable with each of said cooperating hinge means and defining said common pivot, said support member extending laterally away from said hinge means into a desired supporting position, and locking means pivotally connected with one of said pair of members and pivotable to lock and to retain said planar surface of said pair of members in collinear relationship in one relative position for engagement about the leg of a ladder and pivotable to release said members for movement for disengagement from the leg of a ladder.

7. A support as in claim 6, means on one of said members adjustable to engage with a leg of a ladder to which said support is applied.

8. A support as in claim 6, said members each having a generally vertically disposed front wall, a side wall and a rear wall angularly related to its respective front wall to define a through opening therewith smaller at one portion thereof than at the other portion thereof.

9. A support as in claim 8, friction means on said rear walls disposed within said support facing said through opening for frictional engagement with the leg of a ladder to which the same is applied.

10. A support as in claim 8, said support member having support means thereon and being engaged with said cooperating hinge means to connect the same and form a common pivot therefor and being movable within said hinge means and relative thereto to move said support means in any desired position.

* * * * *